US005289675A

United States Patent [19]

Brockmanns et al.

[11] Patent Number: 5,289,675

[45] Date of Patent: Mar. 1, 1994

[54] POT SPINNING ASSEMBLY WITH MOVABLE POT

[75] Inventors: Karl-Josef Brockmanns, Willich; Robert Hartel, Aachen; Josef Derichs, Mönchen-Gladbach, all of Fed. Rep. of Germany

[73] Assignee: W. Schlafhorst AgG & Co., Menchen-Gladbach, Fed. Rep. of Germany

[21] Appl. No.: 854,547

[22] Filed: Mar. 19, 1992

[30] Foreign Application Priority Data

Mar. 19, 1991 [DE] Fed. Rep. of Germany ..... 4108929

[51] Int. Cl.[5] ..... D01H 7/74; D01H 1/08

[52] U.S. Cl. ..... 57/312; 57/76; 57/77; 57/281

[58] Field of Search ..... 57/76, 77, 312, 281

[56] References Cited

U.S. PATENT DOCUMENTS

| | | | |
|---|---|---|---|
| 802,161 | 8/1904 | Gill | 57/312 |
| 2,142,760 | 1/1939 | Prince-Smith | 57/77 |
| 2,232,489 | 2/1941 | Prince-Smith | 57/77 |
| 3,030,761 | 4/1962 | Negishi | 57/52 |
| 3,098,343 | 7/1963 | Negishi | 57/76 |
| 3,205,645 | 9/1965 | Kato | 57/76 |
| 4,915,212 | 4/1990 | Derichs et al. | 57/281 X |

FOREIGN PATENT DOCUMENTS

| | | | |
|---|---|---|---|
| 849521 | 9/1952 | Fed. Rep. of Germany | 57/315 |
| 279248 | 3/1952 | Switzerland | 57/76 |
| 2228950 | 9/1990 | United Kingdom . | |

*Primary Examiner*—Lenard A. Footland
*Assistant Examiner*—William Stryjewski
*Attorney, Agent, or Firm*—Herbert L. Lerner; Laurence A. Greenberg

[57] ABSTRACT

A pot spinning assembly comprises a spinning pot and a yarn guide extending into the spinning pot. A controlled drive causes a relative motion between the spinning pot and the yarn guide during a spinning process. Yarn is deposited in layers on the inner wall of the spinning pot and a spinning cake is formed. The spinning pot is displaced along its longitudinal central axis between an upper end position and a lower end position. An outlet opening of the yarn guide is located in the vicinity of the lower edge region of the spinning pot when it is in the upper end position. A yarn holder for receiving yarn from the spinning pot, and a substantially horizontal transport apparatus for moving the yarn holder to the spinning pot for rewinding the spinning cake onto the yarn holder is provided. The transport apparatus moves the yarn holder away from the spinning pot when it is in the upper end position.

13 Claims, 4 Drawing Sheets

1
2a
2b
2c
2d
3a
3b
3c
3d
4a
4b
4c
4d
5a
5b
5c
5d
6a
6b
6c
6d
7
8a
8b
8c
8d
9
10
11
12
13
14
15
16a
16b
16c
16d
17a
17b
17c
17d
18a
18b
18c
18d
19a
19b
19c
19d
20a
20b
20c
20d
21a
21b
21c
21d
22
23a
23b
23c
23d
24a
24b
24c
24d
25a
25b
25c
25d
26a
26b
26c
26d
27
28
29
30
31
32a
32b
32c
32d
33a
33b
33c
33d
34a
34b
34c
34d
35a
35b
35c
35d
36a
36b
36c
36d
37
38
39
40
41

POT SPINNING ASSEMBLY WITH MOVABLE POT

BACKGROUND OF THE INVENTION

1. Field of the Invention

The invention relates to a pot spinning assembly in which a yarn guide enters into a spinning pot and during the spinning process a relative motion takes place between the pot and the yarn guide; the yarn is deposited in layers on a spinning cake forming on the inner wall of the pot, and the spinning cake is then rewound onto a yarn holder.

In pot spinning processes, it is usual to deposit the yarn on the inner wall of the pot in multiple layers, as so-called spinning cakes, by means of a reciprocating motion of the yarn guide. To rewind the spinning cake, a tube, as a yarn holder, is either introduced into the pot from below once the yarn guide has been removed completely from the spinning pot, or the yarn guide is kept stationary and the spinning pot is lowered onto a tube located below it. An apparatus of this kind is known from Swiss Patent 279 248, for example.

Pot spinning assemblies of this known kind are complicated and expensive. Each one requires two separate lifting devices, either for the yarn guide in the pot or for the yarn guide and in the case of the stationary pot for the tube introduced into the pot. Moreover, the known pot spinning apparatus requires individual removal of the fully wound tubes, or a doffing device for removing the fully wound tubes from the spindles and for setting empty tubes on the spindles.

SUMMARY OF THE INVENTION

It is accordingly an object of the invention to provide a pot spinning apparatus or assembly, which overcomes the hereinfore-mentioned disadvantages of the heretofore-known devices of this general type and which simplifies the delivery of the yarn holders and integrate it fluidly into the spinning process.

With the foregoing and other objects in view there is provided, in accordance with the invention, a pot spinning assembly, comprising a spinning pot having a lower edge region, an inner wall and a longitudinal central axis, a yarn guide having an outlet opening extending into the spinning pot, means for causing a relative motion between the spinning pot and the yarn guide during a spinning process, and means for depositing a yarn in layers and forming a spinning cake on the inner wall of the spinning pot, means for displacing the spinning pot along the longitudinal central axis between an upper end position and a lower end position, the outlet opening of the yarn guide being located in the vicinity of the lower edge region of the spinning pot when the spinning pot is in the upper end position, a yarn holder for receiving yarn from the spinning pot, and a substantially horizontal transport apparatus for moving the yarn holder to the spinning pot for rewinding the spinning cake onto the yarn holder and for moving the yarn holder away from the spinning pot when the spinning pot is in the upper end position.

According to the invention, the longitudinally displaceable support of the spinning pot makes it possible to deliver yarn holders that stand upright, for rewinding the yarn from the spinning cake, via a horizontally arranged transport device. Once the outlet opening of the yarn guide is at the level of the lower edge of the spinning pot in the upper terminal position of the spinning pot, the yarn extends from the yarn guide as far as the lower edge of the spinning pot. If the pot is now lowered for rewinding via an upright yarn holder that has been made available, the yarn is drawn downward and because of the inclined pull on it reaches the region of the yarn holder and thus advantageously applies itself to the furnished yarn holder, so that no further aids are necessary for putting the yarn into contact with the yarn holder.

In accordance with an added feature of the invention, the spinning assembly has spinning stations each including a spinning pot, each being displaceable about respective central longitudinal axes, and including a plurality of further yarn holders each for receiving yarn from a respective one of the spinning pots.

In accordance with an additional feature of the invention, the yarn holder includes a spindle-shaped part for receiving a yarn package and a cylindrical plate, the spindle-shaped part being disposed standing upright and centered on the cylindrical plate.

In accordance with a further feature of the invention, the transport apparatus includes a conveyor belt for bringing the yarn holder to and transport the yarn holder away from the spinning pot.

The spindle-shaped parts of the yarn holders receive the yarn package from the spinning pot. These receiving parts are disposed centered on a cylindrical plate, standing upright. The yarn holders of the invention do not need mandrels for placement at the various spinning stations as is the case for conventional tubes. Nor is any doffing device, known in ring spinning machines, needed for removing the fully wound tubes and for setting up empty tubes. Advantageously, the yarn holders can be delivered and removed under automatic control on a simple transport device, such as a conveyor belt, without requiring any further manipulation for the process of rewinding the spun yarn, except for the manipulation needed for precise positioning.

In a further preferred embodiment, as mentioned above, the yarn holders are transported to and from the spinning stations on a conveyor belt. A conveyor belt is a very simply constructed transport means, and because of the embodiment of the yarn holders with a cylindrical plate as their base, it is assured that unproblematic transporting of the upright spindle-shaped parts, wound with the yarn, is assured.

In accordance with yet a further feature of the invention, the spinning stations have a given width and the cylindrical plates of the yarn holders have diameters being adapted to the given width, and the spacing between the spindle-shaped parts corresponds to the spacing between the central longitudinal axes of the spinning pots when the yarn holders are disposed adjacent one another.

The invention thus provides that the yarn holders are spaced apart from one another on the conveyor belt by the spacing between the spinning pots. As the pots are transported into position, this makes it possible, with the positioning of a single yarn holder at one spinning station, to arrange the other yarn holders as well in a correct position relative to the pots, such that when the pots are lowered for rewinding, they are all centrally surrounded by the yarn holders. Advantageous malfunction-free rewinding from the pots to the yarn holders is thereby assured.

In accordance with yet another feature of the invention, the means for depositing a yarn in layers and forming a spinning cake on the inner wall of the spinning pot include first means for rotating the spinning pot about the longitudinal central axis, second means for building up the spinning cake in layers, and third means for covering each previously deposited layer of yarn with each new layer of yarn, the third means causing the predetermined relative motion between the yarn guide and the spinning pot to continuously increase over time from a starting distance to an end distance in accordance with predetermined limit curves symmetrically defined with respect to a center line perpendicular to the longitudinal central axis.

In other words, to facilitate positioning of the yarn holders further, the invention provides that the diameter of the cylindrical plates of the yarn holders is adapted to the width of a spinning station. Even if the yarn holders might possibly slip on the conveyor belt during transportation, it is thus possible, in positioning only a single yarn holder correctly, for all the other yarn holders to be correctly positioned as well. With abutting yarn holders located one after another, the spacings between the spindle-shaped parts for receiving the yarn package then match the spacings between the center axes of the pots. The diameters of the cylindrical plates of the yarn holders may be dimensioned such for rewinding, that they can be transported from the conveyor belt to a winding machine provided for that purpose.

With the objects of the invention in view, there is further provided, in accordance with the invention, a pot spinning assembly, comprising a spinning pot having an inner wall and defining a longitudinal axis, a yarn guide extending into the spinning pot, first means for depositing yarn in layers on the inner wall of the spinning pot for forming a spinning cake, second means for rewinding the spinning cake onto a yarn holder, and third means for driving the spinning pot in a reciprocating motion along the longitudinal axis for causing a relative motion between the spinning pot and the yarn guide during a spinning process.

In accordance with again a further feature of the invention, the third means superimposes a further reciprocating motion on the spinning pot over the reciprocating motion necessary for changing the yarn holder.

In accordance with again an added feature of the invention, the spinning assembly includes a vertically movable support structure on which the spinning pot is disposed and a control device; the third means is a drive connected to the spinning pot and disposed on the vertically movable support device, and the drive is controlled by the control device. The drive may also drive the support device for executing the reciprocating motion changing the yarn holders.

Accordingly, in the region of the longitudinal motion of the pot, the reciprocating motion required for changing a yarn holder overlaps the reciprocating motion that builds up the spinning cake in the pot. One and the same lifting device is used both for building up the spinning cake and for raising the pot to change the yarn holders. As a result, a separate lifting device, which in the prior art raises and lowers the yarn guide or guides in order to build up the spinning cake, can be dispensed with. The yarn guides according to the invention can each be disposed in stationary fashion at the spinning stations. The spinning motions and the reciprocating motion of the pot as it is lowered or raised for changing the yarn holders may be superimposed on one another in such a way that the pot, for instance, is in its upper position at the onset of spinning and is lowered during the buildup of the spinning cake, so that once the spinning process is ended and the spinning cake has been fully formed, it has already been lowered above an already ready yarn holder, so that rewinding onto the yarn holder can be done directly from this position, without further reciprocating motions.

In another embodiment, the pot can remain in its lowermost position, and the yarn of the spinning cake is already rewound onto the yarn holder, located centered within the pot. As the pot is raised, a new spinning process is already initiated with the upward motion of the pot, so that when the pot is in the raised state, a new spinning cake is already formed on the wall of the spinning pot.

Other features which are considered as characteristic for the invention are set forth in the appended claims.

Although the invention is illustrated and described herein as embodied in a pot spinning assembly, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENT

Figure 1:
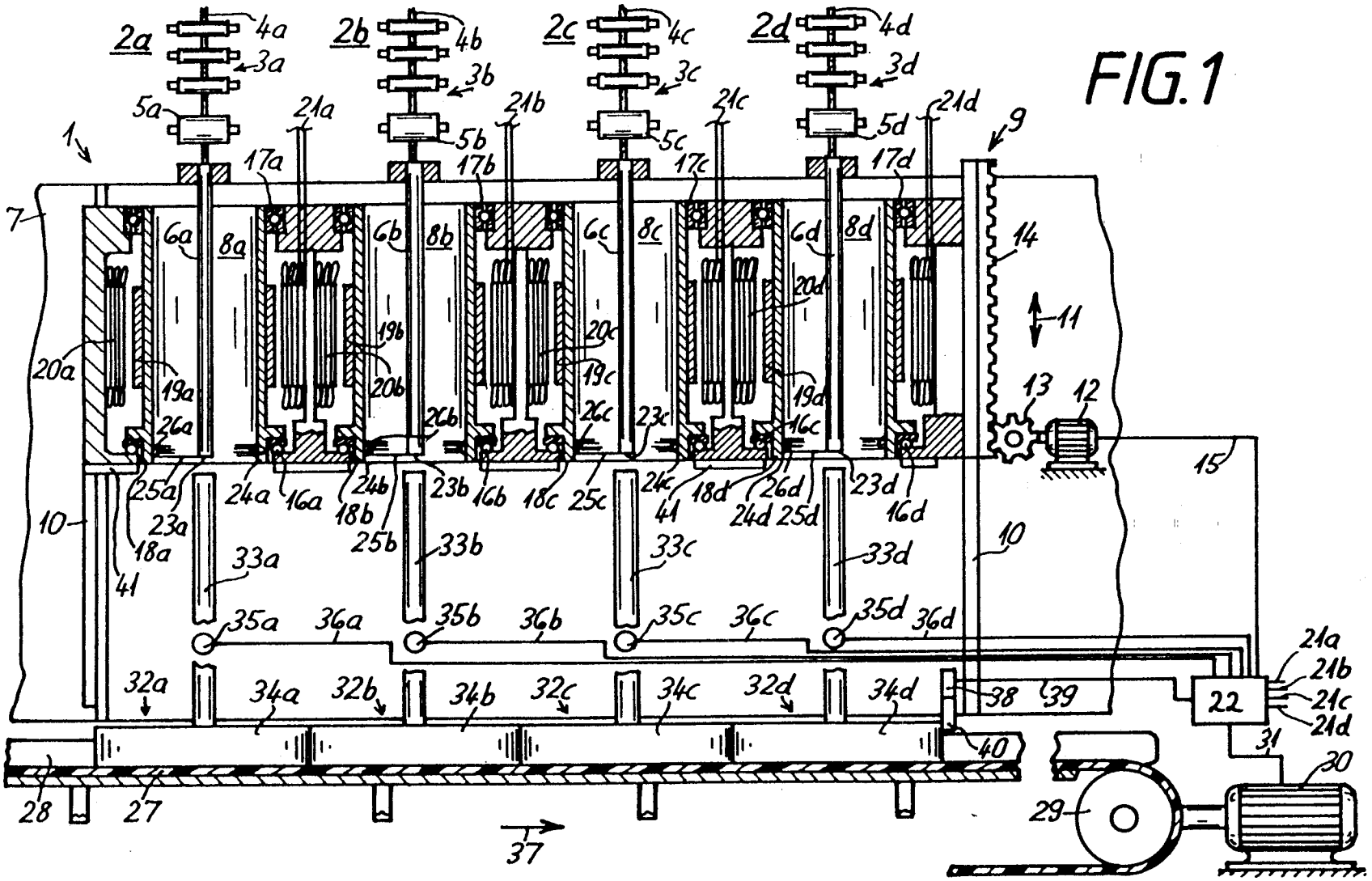
FIG. 1 is a diagrammatic view of the basic structure of a pot spinning apparatus according to the invention, with four spinning stations located adjacent one another.

Referring now to the figures and first, particularly to FIG. 1 thereof, there is seen a part of a spinning machine having pot spinning apparatus Only those characteristics necessary for comprehension of the invention are shown and described.

The pot spinning apparatus 1 includes four spinning stations 2*a*, 2*b*, 2*c* and 2*d*. One sliver 4*a* to 4*d* each is stretched by a respective drafting mechanism 3*a* to 3*d*, here suggested by drafting rollers. As customary, the sliver may be furnished from non-illustrated cans or flyer bobbins. From the delivery rollers 5*a* to 5*d*, the drawn sliver is carried to the various spinning stations 2*a* to 2*d*, into a yarn guide 6*a* to 6*d*. The yarn guides in the present exemplary embodiment are secured in a stationary manner to a frame 7 of the pot spinning apparatus 1. They each protrude centrally into spinning pots 8*a* to 8*d*, forming a center axis of the spinning pots. By way of example, the yarn guides may be tubes, or yarn eyelets made of wire.

The spinning pots 8*a* to 8*d* are disposed adjacent one another jointly on a support device or carrier 9, which is shown in section. The support device 9 is movable vertically up and down and is guided upward and downward in retaining slots or groove guides 10, which are located vertically to the right and left of the spinning stations in the frame 7. The guides located in the plane of the observer have not been illustrated.

However, the spinning pots 8*a* to 8*d* could also be individually supported, so that each spinning pot, independently of the adjacent ones, is driven individually, both in terms of its rotation and for the reciprocating motion to build up the spinning cake and for rewinding or packaging.

The upward and downward motion of the support device 9 is effected with the aid of a motor 12, the pinion 13 of which meshes with a rack 14 that is secured vertically on the support device 9 in the region of the right-hand groove guide 10. The motor 12 is connected to a control device 22 via the control line 15, with which the upward and downward motion of the support devices 9 and lo of the cans 8*a* to 8*d* is controlled.

The pots 8*a* to 8*d* are thin-walled tubes. Their respective bearings 16*a* to 16*d* on the lower edge and bearings 17*a* to 17*d* on the upper edge are shown only schematically here. Specific embodiments for bearings are not limited, and the choice thereof is left to the person of skill in the art.

In the present exemplary embodiment, the spinning pots 8*a* to 8*d* are embodied as rotors of squirrel cage motors. To that end, the tubes 18*a* to 18*d* of the pots may be made from a nonmetallic material around which thin metal rings or sleeves 19*a* to 19*d* are placed as short-circuit rotors in the region of the stator of a respective drive motor. For the rotational drive of the pots, the pots are each surrounded by a stator 20*a* to 20*d* of the squirrel cage motors. The stator windings and the ring of the squirrel cage rotor of the pot drive mechanisms are arranged such that they face one another.

The various squirrel cage motors 20*a* to 20*d* are connected to the control device 22 via control lines 21*a* to 21*d*. The control device 22 controls the rotational speed, or rpm, of the squirrel cage motors and hence of the pots. As mentioned above, the control device 22 is connected via the control line 15 to the motor 12 for driving the support device 9, so that the pots 8*a* to 8*d* execute the reciprocating motions necessary for building up a spinning cake.

FIG. 1 shows the support device 9 in its upper terminal position. As a result, the pots 8*a* to 8*d* are also in their upper terminal position. Since the yarn guides 6*a* to 6*d* in the present exemplary embodiment are disposed in stationary fashion in the frame 7 of the pot spinning apparatus 1, outlet openings 23*a* to 23*d* of the various yarn guides 6*a* to 6*d* are located at the level of a respective lower edge 24*a* to 24*d* of the respective pot 8*a* to 8*d*. The buildup of the spinning cake can begin in this position. As can be seen in FIG. 1, one yarn each 25*a* to 25*d* extends from the outlet openings 23*a* to 23*d* of the various yarn guides 6*a* to 6*d* as far as the inner wall of the spinning pots in the region of the lower edge 24*a* to 24*d* of the respective pots 8*a* to 8*d*. A few layers of yarn of the spinning cakes 26*a* to 26*d* to be built up have already been deposited on the inner walls of the pots 8*a* to 8*d*, as can be seen in FIG. 1.

If the support device 9 is in its upper terminal position, it is possible, on a transport apparatus located below the spinning stations, in the present case a conveyor belt 27, to bring yarn holders 32*a* to 32*d* into position, onto which the yarn, spun in the form of a spinning cake, can be packaged. The conveyor belt 27 runs in a channel 28 and is guided over a deflection roller 29, which is driven by a drive motor 30. The motor 30 communicates with the control device 22 via a control line 31.

The positioning of the yarn holders, among other things, is thus controlled with the aid of the control device 22.

The yarn holders 32*a* to 32*d* each have one spindle-shaped part 33*d* for receiving the yarn winding. The spinning cake located in the pot is packaged or rewound onto the spindle-shaped part. The spindle-shaped parts 33*a* to 33*d* of the yarn holders 32*a* to 32*d* are each disposed upright and centered on a cylindrical plate 34*a* to 34*d* of the respective yarn holder.

The spindle-shaped parts 33*a* to 33*d* for receiving the loose cop must be aligned precisely centered to the respective pot 8*a* to 8*d*. In other words, they are directly opposite the applicable yarn guide 6*a* to 6*d*. To assure proper alignment of the yarn holders, the position of the spindle-shaped parts 33*a* to 33*d* is monitored by a sensor 35*a* to 35*d* at the respective spinning station 2*a* to 2*d*. The sensors 35*a* to 35*d* are connected to the control device 22 by signal lines 36*a* to 36*d*. The conveyor belt 27 is moved until the yarn holders 32, with their spindle-shaped parts 33, are precisely aligned with the sensors 35.

The diameters of the cylindrical plates 34*a* to 34*d* of the various yarn holders 32*a* to 32*d* are adapted to the width of a spinning station. In the case of abutting yarn holders located one after the other, the spacings of the spindle-shaped parts 33*a* to 33*d* for receiving a yarn package are identical to the spacings between one another of the center axes of the spinning pots 8*a* to 8*d*. Once the first yarn holder is correctly positioned, or in other words when its spindle-shaped part is centered with respect to the pot, then the other yarn holders are correctly positioned as well, as long as they are disposed abutting one another on the conveyor belt. In the present exemplary embodiment, the yarn holders 32 are brought to the spinning stations in the direction of an arrow 37.

For correct positioning of the first yarn holder 32*d* arriving at the spinning station 2*d*, a mechanical stop device 38 is provided on the channel 28. The stop device 38 is activated by the control device 22 via the control line 39 whenever empty yarn holders are brought to it. A mechanical stop 40 then moves into the path of the yarn holders and stops the first yarn holder 32*d* delivered, in an accurately centered position with respect to the pot 8*d*. The arrival of the yarn holder and its correct positioning are ascertained by means of the sensor 35*d*, and this is reported to the control unit 22 over the signal line 36*d*. If all the yarn holders stand abutting one another on the conveyor belt, then all the other yarn holders 32*a* to 32*d* have thus simultaneously arrived at the spinning stations 2*a* to 2*d* intended for them and are also simultaneously accurately aligned. If that is not the case, then the drive motor 30 for driving the conveyor belt 27 remains switched on until all the yarn holders 32*a* to 32*c* have arrived and are disposed abutting one another on the belt 27. The first yarn holder 32*d* to arrive is stopped by means of the stop 40, so that the belt continues to slide under the plate 34*d*. The same is true for the succeeding yarn holders 32*a* to 32*c*. Only if the sensor 35*a* reports the proper positioning of the spindle-shaped part 33*a* of the yarn holder 32*a* to the control device 22 via its signal line 36*a* is the drive motor 30 of the deflection roller 29 of the conveyor belt 27 stopped. As mentioned, the control device 22 activates and deactivates the motor 30 through the control line 31.

If the yarn holders are ready, then the buildup of the spinning cake can begin, in that the support device 9, in a manner comparable to a ring rail on a ring spinning machine, executes reciprocating motions up and down, as indicated by a double arrow 11. To this end, the support device 9 in the present exemplary embodiment also moves from top to bottom, so that the spinning cake on the inner wall of the pots 8*a* to 8*d* is built up from bottom to top. After the buildup of the spinning cake is ended, the respective drafting mechanisms 3*a* to 3*d* are stopped, so that any superfluous supply of sliver is prevented. Once the spinning cake has been completely built up, the support device 9 simultaneously is in its lower terminal position. In this position, clamping strips 41 located on the support device 9 press against the cylindrical plates 34*a* to 34*d* of the yarn holders 32*a* to 32*d*. This prevents the yarn holders from rotating about their respective axes during rewinding and thereby impairing the packaging of the yarn.

Rewinding onto the yarn holders takes place automatically and is comparable to the rewinding process described in Swiss Patent 279 248, FIGS. 7 to 9. If the pots 8*a* to 8*d* are each in their lower terminal position, then the yarns emerging from the outlet openings 23*a* to 23*d* of the yarn guides 6*a* to 6*d* extend as far as the upper edges of each of the pots. They come into contact there with the upper ends of the spindle-shaped parts 33*a* to 33*d* of the yarn holders 32*a* to 32*d*. Catch hooks as in Swiss Patent 279 248, that hold the yarns firmly may be disposed on these upper ends of the spindle-shaped parts, although this is not shown in detail here. The yarn is caught and severed and wraps around the spindle-shaped part, so that thereafter the spinning cake is automatically rewound from the inner wall of the applicable pots onto the spindle-shaped part.

After the rewinding, the support device 9 is returned to its upper terminal position, and as a result the yarn holders are freed. The stop device 38 is actuated via the control device 22 and retracts the stop 40. The drive motor 30 of the conveyor belt 27 is turned on, and the yarn holders 32*a* to 32*d* disposed on the belt are moved to a non-illustrated winding machine, where they are rewound. From there, they can be returned, empty, to the pot spinning apparatus again. During the transfer of the yarn to the spindle-shaped parts or the removal of the yarn holders with the loose cops, the yarn located between the yarn guides and the yarn holders is severed by a cutting device located on the top of the spindle-shaped parts. At the same time, when the conveyor belt 27 is turned on, the drafting mechanisms 3*a* to 3*d* are turned on again, so that sliver is again fed into the various yarn guides 6*a* to 6*d* via the delivery rollers 5*a* to 5*d*. During the removal of the yarn holders, as a result of the commencing delivery of sliver, the yarn end that has been cut off and extends out of the yarn guides is brought to the region of the walls of the spinning pots, so that a new spinning process is initiated.

After the removal of the yarn holders filled with the loose cops, empty yarn holders are immediately brought to the spinning stations, so that the next spinning process can be initiated with the least possible delay.

Figure 2:
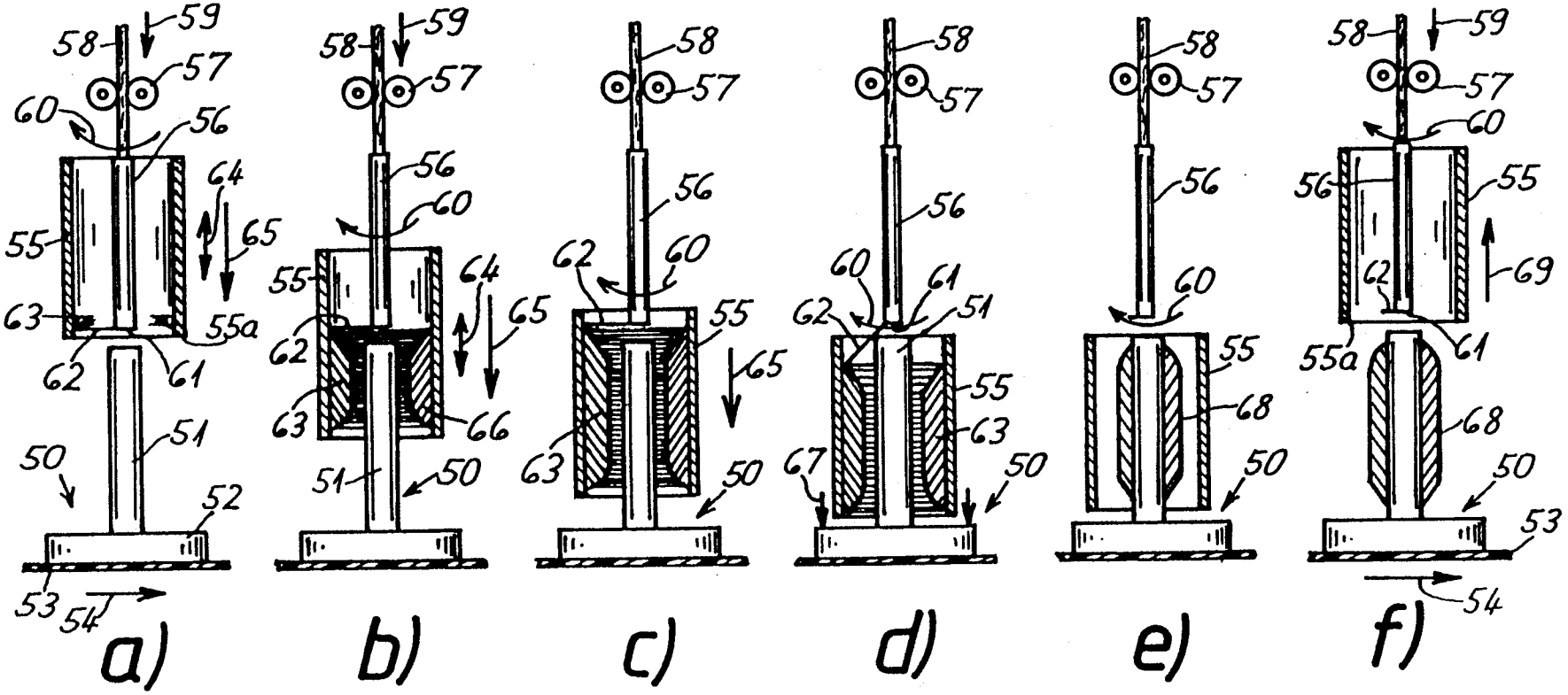
FIGS. 2 and 3 are schematic views of various phases in pot spinning for two differently built-up spinning cakes.
Figure 3:
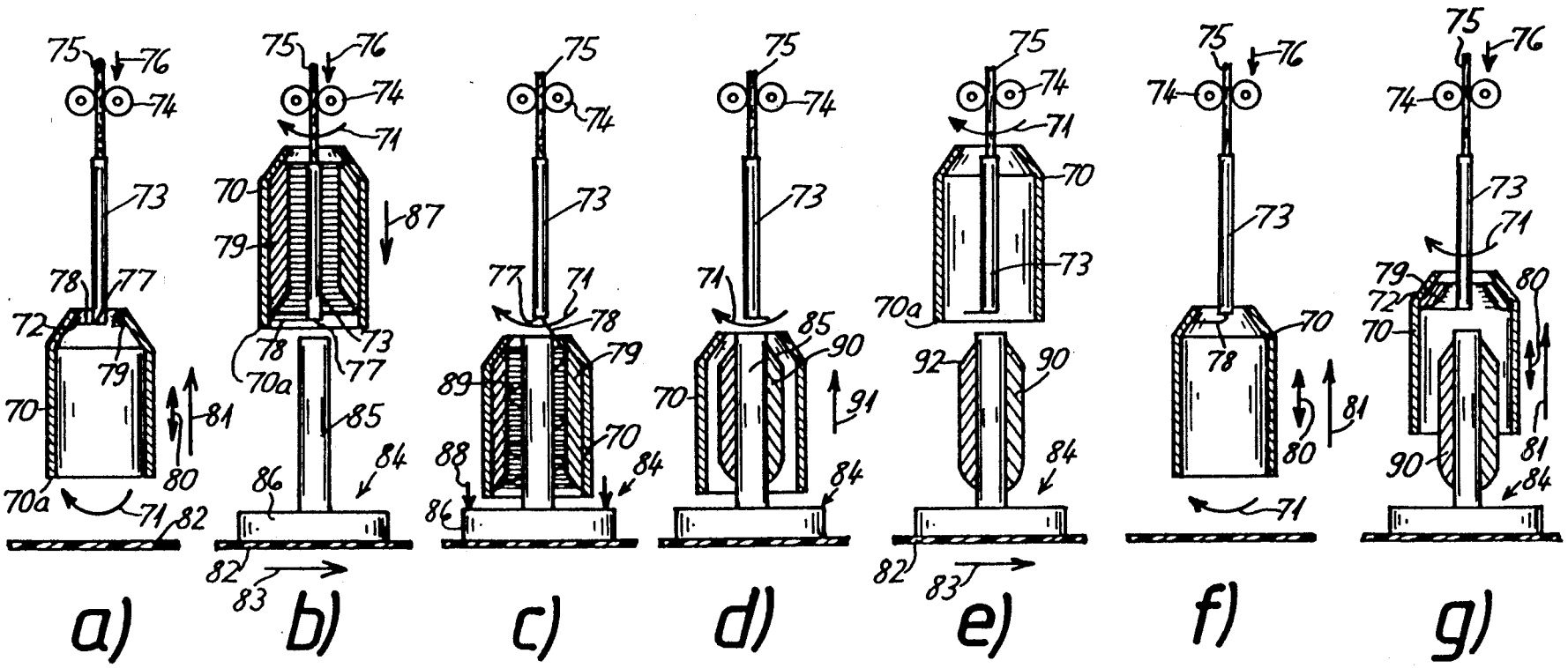

The mode of operation of a pot spinning apparatus according to the invention will now be described by way of example, with the buildup of spinning cakes having different yarn layer orientations, in conjunction with FIGS. 2 and 3. The drawings are purely schematic and are limited to the characteristics necessary to explain the mode of operation. FIGS. 2*a* to 2*f* show the same spinning station at various times in a spinning cycle. In its embodiment, the spinning station is intended to be identical to the spinning stations of the exemplary embodiment of FIG. 1.

In FIG. 2*a*, a yarn holder 50 with a spindle-shaped part 51 for receiving the loose cop is ready at the spinning station. The spindle-shaped part 51, as in the preceding exemplary embodiment, stands upright, disposed on a cylindrical plate 52. The yarn holder 50 is brought to the spinning station by a conveyor belt 53 in the transport direction 54 and is positioned at the station. Located above the yarn holder 50 is the spinning pot 55 in its uppermost position. The yarn guide 56 protrudes centrally into the pot at its center axis. The yarn guide 56 is disposed in a stationary fashion. By means of a delivery mechanism 57, which is not shown in great detail here, a drawn sliver 58 is passed into the yarn guide 56, as indicated by the arrow 59. The outlet opening 61 of the yarn guide 56 is at the level of a lower edge 55*a* of the pot 55.

The pot 55 rotates at a constant rotational speed, as indicated by the arrow 60. The sliver emerging from the outlet opening 61 of the yarn guide 56 is deposited on the inner wall of the pot, and a yarn rotation is thereby imparted to it. As can be seen from FIG. 2*a*, the yarn 62 emerging from the outlet opening 61 of the yarn guide is deposited in layers as a spinning cake 63, on the inner wall of the pot, beginning at the lower edge 55*a* of the spinning pot 55.

The pot in the present exemplary embodiment executes not only a rotational motion but also a linear translational motion, comparable to the motions of a ring rail. The reciprocating upward and downward motions, as indicated by the arrow 64, serve to build up yarn layers in conical form, of the kind known for the yarn layer buildup of a spinning bobbin. The buildup of the cake 63 is from bottom to top, in the course of which the pot moves downward in the direction of the arrow 65.

FIG. 2*b* shows the buildup of the cake 63 in layers 66 forming the jacket of a cone, the tip of which points downward. The spinning cake has already been half finished and the pot 55 has already been lowered correspondingly deeply in the direction of the arrow 65, past the spindle-shaped part 51 of the yarn holder 50.

FIG. 2*c* shows the moment when the spinning cake 63 is finished. The transport of sliver is stopped, which is indicated in that the supply arrow 59 is not shown in FIG. 2*c*. The last yarn layer has been applied to the inner wall of the spinning pot 55. The downward motion of the pot in the direction of the arrow 65 is continued, however, until such time as the pot has attained the position as shown in FIG. 2*d*.

While the pot 55 is in its lowermost position, the rewinding of the spinning cake 63 begins onto the spindle-shaped part 51 of the yarn holder 50. To this end, the yarn holder 50 is stopped as indicated by an arrow 67, for instance by the holder of the pot, in such a way that it cannot execute any rotational motion during the rewinding.

The rewinding process is automatically initiated by the provision that the yarn 62, extending from the spinning cake 63 to the outlet opening 61 of the yarn guide 56, is engaged by the upper end of the spindle-shaped part 51. The fastening of the yarn can, for instance, be done by means of a non-illustrated catch hook. At the same time, the yarn is severed at this point. While the pot continues to rotate the yarn from the spinning cake 63 winds onto the spindle-shaped part 51 of the yarn holder 50.

In FIG. 2*e*, the spinning cake has been fully rewound onto the yarn holder 50, and a yarn package 68 shows a structure of conical yarn layers, of the kind known from spinning bobbins of a ring spinning machine.

FIG. 2*f* shows the initiation of a new spinning process and the removal of the loose cop 68 on the yarn holder 50. The pot 55 is returned to its uppermost position, as indicated by the arrow 69. Once the upward motion 69 of the pot has ended, the delivery of sliver 58 is resumed, as represented by the arrow 59. The sliver 62 emerging from the outlet opening 61 of the yarn guide is spun into a yarn by the action of the centrifugal force of the spinning pot and deposited onto the wall to form a new spinning cake, while the yarn holder 50 with the yarn package 68 is removed in the transport direction 54 by the conveyor belt 53 and replaced with an empty yarn holder, whereupon the above cycle of winding is closed and begins again at FIG. 2*a*.

A second embodiment for forming a a spinning cake will be explained in the following in conjunction with FIG. 3.

In FIG. 3*a*, a spinning pot 70 rotates in the direction of an arrow 71 in its lowered position. An upper edge 72 is conically shaped. The conicity is intended to facilitate the formation of a conical tip of the yarn package on the yarn holder. In a yarn guide 73, which is located at the center axis of the pot 70 and disposed in stationary fashion, a drawn sliver 75 is furnished from a delivery mechanism 74, as indicated by an arrow 76. From an outlet opening 77 of the yarn guide 73, a yarn 78 extends to the inner wall of the pot 70. Since the spinning process has only just begun, only a few yarn layers have thus far been deposited as a spinning cake 79 on the conical edge 72 of the spinning pot 70.

As in the previous example, the spinning pot 70 likewise executes reciprocating motions, which are comparable to the motions of a ring rail of a ring spinning machine. This is represented by a double arrow 80. A general lifting motion 81 of the spinning pot 70 is superimposed on this double reciprocation 80 for forming the various yarn layers of the spinning cake 79.

In FIG. 3*b*, the spinning pot has reached its upper position. In this position, the spinning cake 79 has been completely built up from top to bottom. The yarn 78 still extends from the outlet opening 77 of the yarn guide 73 to the inner wall of the pot 70. The outlet opening 77 of the yarn guide 73, in this position of the spinning pot 70, is located opposite the lower edge 70*a* thereof. Below the spinning pot 70, filled with the spinning cake 79, a yarn holder 84 is brought to the spinning station and positioned centrally below the pot, via a conveyor belt 82, in a transport direction 83. The spinning cake 79 is rewound as a yarn package 90 onto the spindle-shaped part 85, which stands upright and centered on a cylindrical plate 86. At this point, the pot 70 is moved downward in the direction of an arrow 87 and fits over the spindle-shaped part 85 of the yarn holder 84.

In FIG. 3*c*, the pot 70 has attained its lowermost position. Before the rewinding process begins, the yarn holder 84 is clamped, as indicated by an arrows 88, so that the yarn holder will not be set into rotational motion during the rewinding.

During the downward motion of the pot to the position shown here, sliver 75 continues to be furnished until such time as the pot 70 has reached its lowermost position. This produces an upwardly spiraling yarn cop 89. The yarn 78 is drawn from the outlet opening 77 of the yarn guide 73 over the upper edge of the spindle-shaped part 85 of the yarn holder 84. As in the preceding exemplary embodiments, a catch hook may be provided here as well, which catches the yarn, severs it and initiates the process of rewinding onto the yarn holder. The progress of the rewinding has already been described in detail in the context of the first embodiment.

In FIG. 3*d*, the spinning cake 79 has been rewound as a loose cop 90 onto the spindle-shaped part 85 of the yarn holder 84. The clamping 88 of the yarn holder 84 is released, and a lifting motion 91 is initiated to raise the pot 70 to its upper position.

FIG. 3*e* shows the pot 70 in its upper position in which the yarn holder 84 with the yarn package 90 can be removed. To this end, the conveyor belt 82 is set into motion in the transport direction 83.

After the removal of the yarn holder 84, the pot 70 is returned to its lower position, as shown in FIG. 3*f*. FIG. 3*f* corresponds to FIG. 3*a*. It shows the beginning of the formation of the spinning cake, in that the delivery mechanism 74 is turned on again and the sliver 74 is fed into the yarn guide 73, as indicated by the arrow 76. The yarn 78 emerges from the yarn guide and is deposited again as a spinning cake on the inner wall of the pot 70. The remaining course has already been described in the description of FIG. 3*a*.

FIG. 3*g* shows a modification of the process progression. Instead of moving the pot upward solely in order to liberate and remove the yarn holder 84, as shown in FIG. 3*e* and described in the context thereof, the yarn holder 84 now remains inside the pot with its yarn package 90. A new cake is formed, in a manner comparable to that described for FIG. 3*a*, by reciprocating and raising the pot from the yarn holder 84. In this embodiment, a raising and lowering motion of the pot becomes unnecessary. Changing of the filled yarn holder for an empty one is done whenever the pot, with its completely spun spinning cake, is in its upper position, as shown in FIG. 3*b*.

In contrast to the preceding exemplary embodiment, the conical layers 92 of the yarn package 90 are in the opposite direction from the layers of the yarn package 68.

Figure 4:
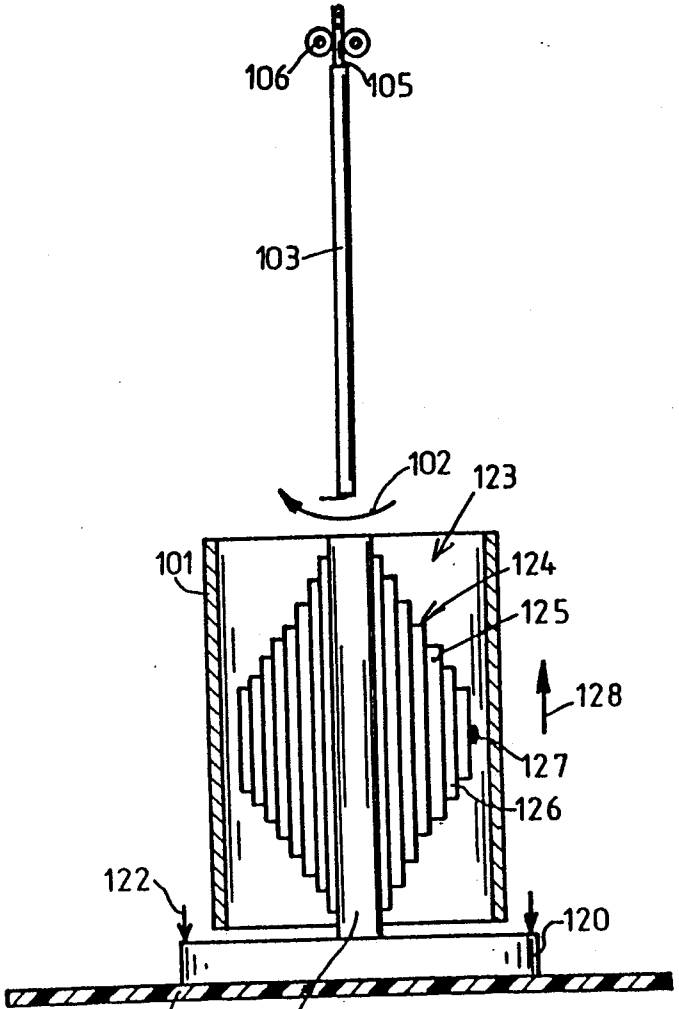
FIG. 4*a* is a diagrammatic view of another variation of a spinning cake buildup.
FIG. 4*b* shows details of the formation of the spinning cake.
FIG. 4*c* shows the buildup of the rewound spinning cake or the yarn package on the yarn holder.
Figure 4:
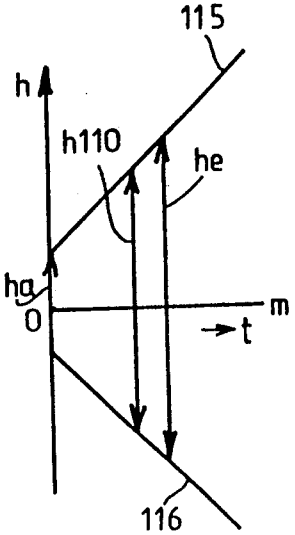
Figure 4:
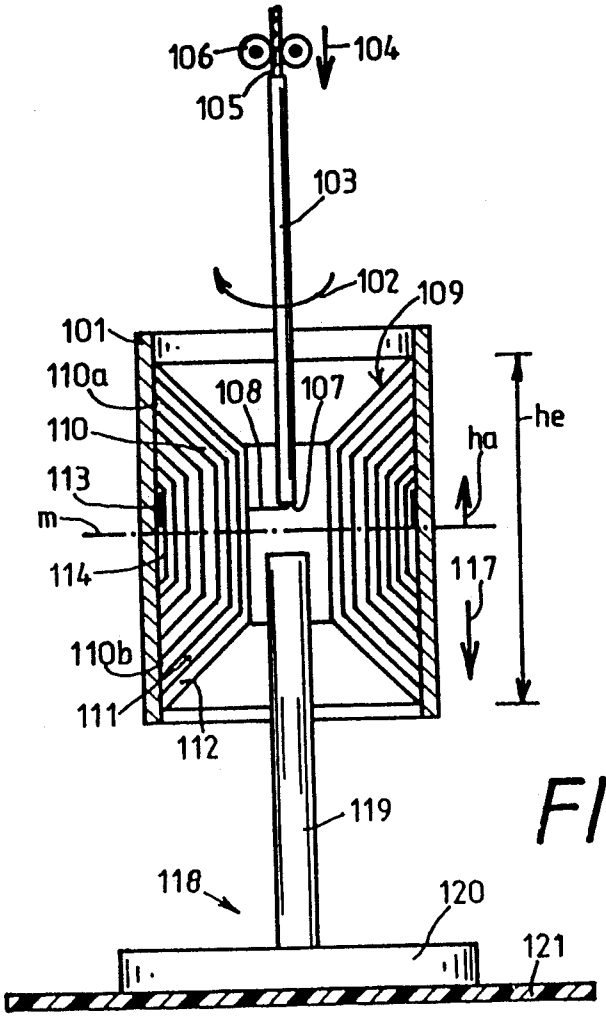

FIG. 4 shows yet a further embodiment of the pot spinning process. The buildup of a cake 109 takes place on the inner wall of the pot in layers, which, with increasing cake thickness, cover one another at the ends. Beginning with an initial stroke of a yarn guide that accomplishes the deposit of the yarn in the pot, the stroke is lengthened as the cake thickness increases. Upon rewinding, a flyer winding with a layered structure then automatically results, with the layer length decreasing as the winding thickness increases. If the yarn breaks, the yarn end can easily be found, because it must always be located in the outermost layer of the cake, and because the outermost layer covers all the other layers.

The third embodiment for forming a spinning cake will now be described with reference to FIG. 4.

A pot 101 rotates in the direction of an arrow 102. A yarn guide 103, located at the center axis, protrudes into the pot 101. As represented by an arrow 104, a drawn sliver 105 is furnished through the yarn guide 103 by a delivery mechanism 106. A yarn 108 extends from an outlet opening 107 of the yarn guide 103 as far as to an inner wall of the pot 101.

As FIG. 4*a* shows, the buildup of the spinning cake 109 has ended. The buildup of the spinning is done in individual layers 110, the ends 110*a* and 110*b* of which on the inner wall of the pot 101 are each covered by the next subsequent layer 111. The last layer, 112, covers the layer 111 located immediately under it and all the other layers below that.

The buildup of the spinning cake proceeds in accordance with the following course of the process:

Beginning at a center line m of the pot 101, one yarn layer 113 is first spun on the inner wall of the pot, as a starting layer. Beginning at the center line m, either the pot or the yarn guide initially executes a starting stroke ha for that purpose. This first yarn layer 113 is completely covered by the next yarn layer 114. With each further stroke, an increase in the relative motion between the pot and the yarn guide takes place, so that as the cake thickness grows the stroke becomes longer to both sides. Thus one yarn layer is completely covered by the next yarn layer, and that yarn layer always ends on the inside of the pot.

In FIG. 4*b*, the increase in the relative motion between the pot 101 and the yarn guide 103, that is, the lengthening stroke h over time t, is plotted in a diagram. This diagram shows the course of the stroke height h over the time t. Beginning at the center line, a starting stroke ha takes place at time 0. As the diagram of FIG. 4*b* shows, the stroke length h increases as a function of time and thus as the cake thickness increases, symmetrically with the center line m, within the limit curves 115 and 116. For the yarn layer 110, for instance, a stroke length of h 110 is necessary. For depositing the last yarn layer 112, the stroke length he is necessary.

FIG. 4*a* shows the situation in which the buildup of the spinning cake has ended. The pot 101 with the spinning cake 109 is lowered in the direction of the arrow 117 onto a yarn holder 118 for rewinding. The rewinding is intended to be done onto a spindle-shaped part 119, which stands upright and centered on a cylindrical plate 120. The yarn holder 118 has been brought to the spinning station on a conveyor belt 121 and positioned there.

For rewinding, the pot 101 is moved downward in the direction of the arrow 117 and in this process fits over the spindle-shaped part 119 of the yarn holder 118. For the rewinding process, the yarn holder 118 is clamped, as indicated by the arrows 122 in FIG. 4*c*, so that the yarn holder will not be set into rotation during the rewinding. During the rewinding process, the delivery of sliver 105 by the yarn guide 103 is stopped, while the pot 101 continues to rotate in the direction of the arrow 102.

FIG. 4*c* shows the situation in which the spinning cake has been completely rewound from the inner wall of the pot 101 onto the spindle-shaped part 119 of the yarn holder 118. As FIG. 4*c* shows, a yarn package 123 has formed on the spindle-shaped part 119; its winding is built up in the manner of a flyer bobbin, in which all the layers 124 are concentrically located. Each of the newly formed layers is shorter than the one before. The gradation of the various layers is shown in exaggerated fashion in the present drawing, to make the structure clearer. For instance, the layer 125 is longer than the layer 126 above it. A yarn end 127 is located on the uppermost layer and thus can be grasped immediately for further processing. However, it can also be deposited away from the uppermost layer past all the yarn layers onto the top end of the spindle-shaped part 119 in the form of a starting winding, for instance in the form of several yarn windings located side by side.

A buildup of the spinning cake of this kind, as described in conjunction with the preceding exemplary embodiment, has the advantage that during the spinning process and during the rewinding process, the yarn always comes to rest freely on the uppermost layer of the yarns and can thus easily be found if yarn breaks occur.

After the rewinding process is ended, as shown in the pot 101 is lifted from the yarn holder 118 in the direction of an arrow 128. Another buildup of a spinning cake in accordance with the described method then takes place. The clamping 122 of the plate 120 of the yarn holder 118 is released, and the yarn holder 118 with the finished yarn package 123 is delivered to the next processing station by means of the conveyor belt 121.

We claim:

1. A pot spinning assembly, comprising a spinning pot having a lower edge region, an inner wall and a longitudinal central axis, a yarn guide having an outlet opening extending into said spinning pot, means for displacing said spinning pot along said longitudinal central axis between an upper end position and a lower end position for causing a relative motion between said spinning pot and said yarn guide during a spinning process, and means for depositing a yarn in layers and forming a spinning cake on said inner wall of said spinning pot, said outlet opening of said yarn guide being located in the vicinity of said lower edge region of said spinning pot when said spinning pot is in said upper end position, a yarn holder for receiving yarn from said spinning pot, and a substantially horizontal transport apparatus for moving said yarn holder into a rewinding position at said spinning pot in a substantially horizontal direction, means for rewinding the spinning cake onto said yarn holder in the rewinding position with said spinning pot, and means for moving said yarn holder away from the rewinding position at said spinning pot in a substantially horizontal direction when said spinning pot is in said upper end position.

2. The spinning assembly according to claim 1, including spinning stations, each of said spinning stations having a respective one of said spinning pots, each being displaceable about respective central longitudinal axes, and including a plurality of further yarn holders each for receiving yarn from a respective one of said spinning pots.

3. The spinning assembly according to claim 2, wherein said transport apparatus includes a conveyor belt for bringing said yarn holders to and transport said yarn holders away from said spinning stations.

4. The spinning assembly according to claim 2, wherein each of said yarn holders include a respective spindle-shaped part for receiving a yarn package and a cylindrical plate, said spindle-shaped parts being disposed standing upright and centered on a respective one of said cylindrical plates.

5. The spinning assembly according to claim 4, wherein said spinning stations have a given width and wherein said cylindrical plates of said yarn holders have diameters substantially corresponding to said given width, and wherein spacings between said spindle-shaped parts equal spacings between said central longitudinal axes of said spinning pots when said yarn holders are disposed adjacent one another.

6. The spinning assembly according to claim 1, wherein said yarn holder includes a spindle-shaped part for receiving a yarn package and a cylindrical plate, said spindle-shaped part being disposed standing upright and centered on said cylindrical plate.

7. The spinning assembly according to claim 1, wherein said transport apparatus includes a conveyor belt for bringing said yarn holder to and transport said yarn holder away from said spinning pot.

8. The spinning assembly according to claim 1, wherein said means for depositing a yarn in layers and forming a spinning cake on said inner wall of said spinning pot include first means for rotating said spinning pot about said longitudinal central axis, second means for building up the spinning cake in layers, and third means for covering each previously deposited layer of yarn with each new layer of yarn, said third means causing said predetermined relative motion between said yarn guide and said spinning pot and the layers creating the cake to continuously increase over time from a starting distance to an end distance during spinning in accordance with predetermined limit curves symmetrically defined with respect to a center line of said pot perpendicular to said longitudinal central axis.

9. A pot spinning assembly, comprising a spinning pot having an inner wall and defining a longitudinal axis, a yarn guide extending into said spinning pot, first means for depositing yarn in layers on said inner wall of said spinning pot for forming a spinning cake, second means for rewinding said spinning cake onto a yarn holder, and third means for driving said spinning pot in a reciprocating motion along said longitudinal axis for causing a relative motion between said spinning pot and said yarn guide during a spinning process, and means for automatically supplying said yarn holder to and removing said yarn holder form said spinning pot.

10. The spinning assembly according to claim 9, wherein said third means superimposes a further reciprocating motion on said spinning pot necessary for changing the yarn holder, over said reciprocating motion.

11. The spinning assembly of claim 10, including a vertically movable support structure on which said spinning pot is disposed and including a control device, wherein said third means is a drive connected to said spinning pot and disposed on said vertically movable support device, and wherein said drive also drives said support device for executing the reciprocating motions changing the yarn holders, said drive being connected to and being controlled by said control device.

12. The spinning assembly of claim 9, including a vertically movable support structure on which said spinning pot is disposed, a control device, said third means being a pot drive connected to said spinning pot and disposed on said vertically movable support structure, and a support structure drive controlled by said control device.

13. The spinning assembly according to claim 9, wherein said means for depositing a yarn in layers and forming a spinning cake on said inner wall of said spinning pot include rotating means for rotating said spinning pot about said longitudinal central axis, layering means for building up the spinning cake in layers and for covering each previously deposited layer of yarn with each new layer of yarn, said third means causing said predetermined relative motion between said yarn guide and said spinning pot and the layers creating the cake to continuously increase over time from a starting distance to an end distance during spinning in accordance with predetermined limit curves symmetrically defined with respect to a center line of said pot perpendicular to said longitudinal central axis.

* * * * *